United States Patent [19]

Badders

[11] 3,994,029

[45] Nov. 30, 1976

[54] FLUID CONTROL SYSTEM

[76] Inventor: Edwin T. Badders, 3087 Riverside Drive, Pomona, Calif. 91766

[22] Filed: Feb. 27, 1975

[21] Appl. No.: 553,590

[52] U.S. Cl. ..... 4/41; 4/52; 4/57 R; 4/61; 4/62; 4/67 R; 137/445; 251/232

[51] Int. Cl.[2] ..... E03D 1/36; E03D 3/04

[58] Field of Search ..... 4/57 R, 57 P, 67 R, 4/67 A, 41, 37, 34, 61, 62; 137/445; 251/232

[56] References Cited

UNITED STATES PATENTS

| | | | |
|---|---|---|---|
| 2,341,116 | 2/1944 | Owens | 4/41 |
| 2,591,975 | 4/1952 | Southwick | 4/41 |
| 2,644,952 | 7/1953 | Boyd | 4/67 R |
| 2,740,129 | 4/1956 | Braswell, Jr. | 4/57 R |
| 2,744,262 | 5/1956 | Boyd | 4/67 R |
| 2,838,765 | 6/1958 | Hosking | 4/41 |
| 2,867,820 | 1/1959 | Gray | 4/41 |

*Primary Examiner*—Henry K. Artis
*Attorney, Agent, or Firm*—Lyon & Lyon

[57] ABSTRACT

Described herein is a pressure activated fluid control system particularly adapted for use as a flushing mechanism for toilets of the water tank type. The system includes a push-button actuated needle valve assembly which, in the shutoff position, presses against a movable valve seat; a pressure actuated direction flow valve; and a tank ball lifting mechanism. The direction flow valve is in fluid communication with the needle valve assembly and includes a floating piston which upon actuation of the needle valve, allows incoming water under line pressure to pass to the lifting mechanism, raise a lift piston and lift the tank ball from the cistern drain. The tank ball depends from a piston disposed within a water filled lower cylinder and following the draining of the cistern, the tank ball slowly and precisely returns to the cistern drain as the water below the piston head within the lower cylinder passes from the cylinder through a check valve disposed about the piston rod. A float is connected to the needle valve to close the valve upon refilling of the cistern and prevent further fluid flow to the lifting mechanism.

17 Claims, 4 Drawing Figures

FLUID CONTROL SYSTEM

BACKGROUND OF THE INVENTION

The water tank type toilet or water closet commonly installed in homes or apartments is provided with a simple flushing mechanism which is generally comprised of a series of mechanical linkages which act to pull the tank ball from the tank or cistern drain by means of a connecting chain upon rotation of a pivotally mounted external handle. When the tank is flushed, the tank ball freely falls back over the cistern drain and the cistern is refilled. While this mechanism is quite simple, it has several shortcomings. The flushing operation is quite noisy, which is generally unpleasant. Difficulty is often encountered in rotating the flushing handle which often results in a loss of a portion of the water held in the cistern which results in a less efficient flushing of the toilet bowl. This occurs as a result of the tank ball being initially only partially lifted from the cistern drain and thereby allowing water to pass therethrough prior to the complete flushing of the bowl. When the ball is then completely lifted from the cistern drain and flushing occurs, less water is available to carry out the flushing operation. Furthermore, the standard flushing mechanism which allows the tank ball to freely drop back onto the cistern drain often causes an imperfect seal between the tank ball and cistern drain, resulting in a "running toilet" with water continually leaking through this imperfect seal.

In a toilet flush mechanism, it is highly desirable to release all of the water held within the cistern drain immediately upon actuation because the greater amount of water provides a more thorough flushing of the toilet bowl. To accomplish a rapid flush of all the water held within the cistern, it is necessary to rapidly lift the tank ball from the cistern drain to prevent any premature leakage of the water supply which necessarily results when the tank ball is slowly withdrawn from the drain. In addition to rapidly lifting the tank ball, a toilet mechanism should slowly and precisely lower the tank ball onto the cistern drain after flushing to assure proper seating of the ball and provide a watertight seal and thereby prevent annoying leakage down the cistern drain. Additionally, the toilet flushing mechanism which accomplishes the rapid lift and slow and accurate return of the tank ball should be relatively quiet in its operation and compatible with the tank type toilets currently in use.

SUMMARY OF THE INVENTION

Briefly, the present invention relates to a fluid control system, which in the preferred embodiment is utilized in a flushing mechanism for toilets of the water tank type. The system includes a push-button actuated valve which creates a pressure differential to control a direction flow valve mechanism. The direction flow valve mechanism, upon actuation, directs the incoming water under line pressure to a lifting mechanism which is secured to the tank ball seated in the cistern drain. The lifting mechanism, under the force of the incoming water, then rapidly raises the tank ball from the cistern drain, resulting in the flushing thereof. After the tank is drained, the lifting mechanism allows the tank ball to slowly and precisely return to the cistern drain, creating a watertight seal therewith and the tank is refilled.

It is the principal object of the present invention to provide a precise pressure activated fluid control system.

It is another object of this invention to provide a flushing mechanism for toilets of the water tank type superior to those heretofore available.

It is still another object of the present invention to provide a flushing mechanism for toilets of the water tank type which is very quiet during operation and provides a rapid lifting of the tank ball from the cistern drain.

It is yet another object of the present invention to provide a flushing mechanism for toilets of the water tank type which reduces water leakage down the cistern drain.

It is still another object of the present invention to provide a flushing mechanism for toilets of the water tank type which maintains the desired water level within the water tank.

A still further object of the present invention is to provide a fluid control valve having a positive closing action to prevent leakage therethrough.

These and other objects and advantages of the present invention will become apparent from the following detailed description taken in conjunction with the accompanying drawings.

IN THE DRAWINGS

Figure 1:
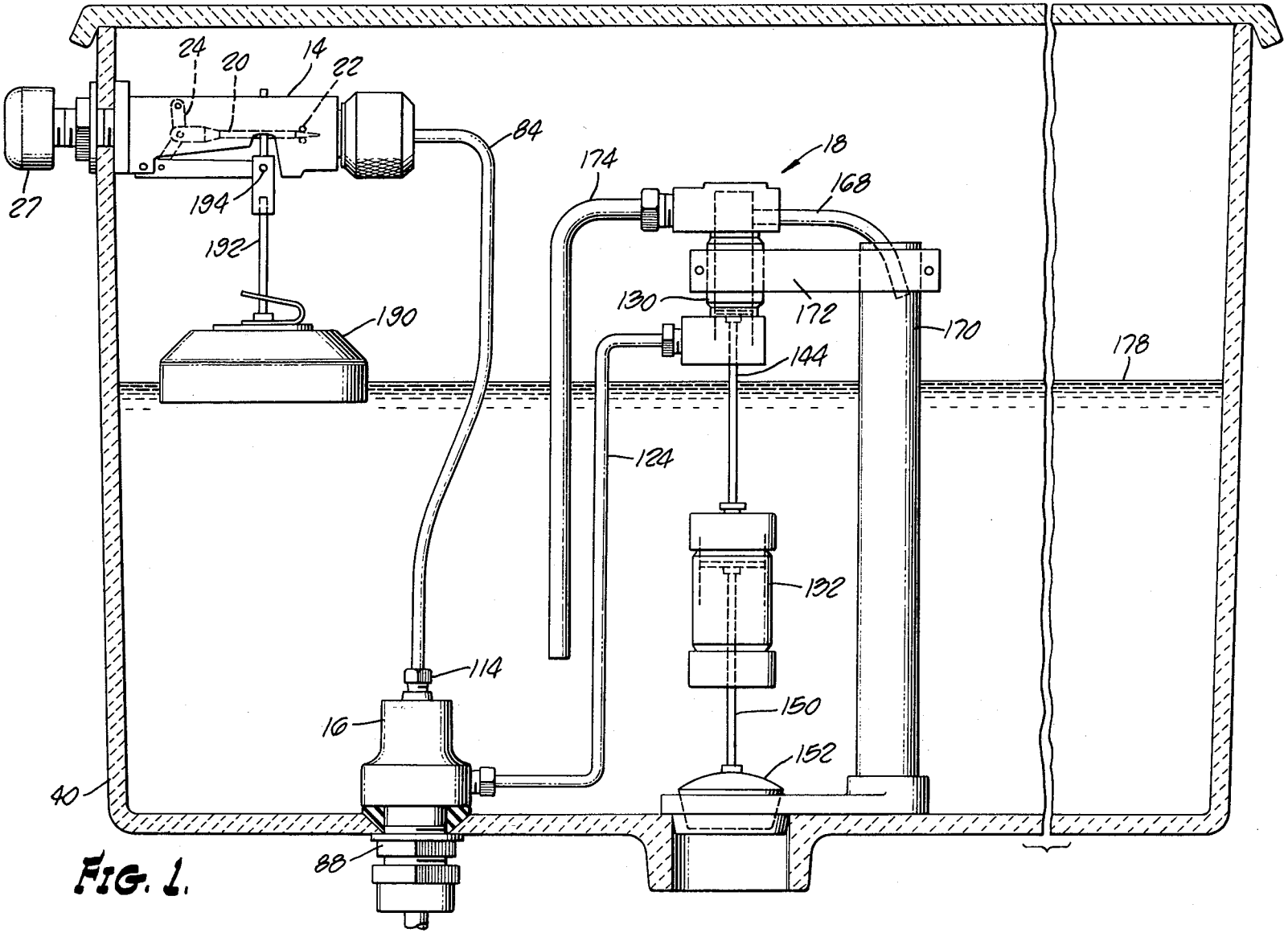
FIG. 1 is a sectional view of a tank type toilet embodying the flushing mechanism which constitutes the preferred embodiment of the present invention.
Figure 2:
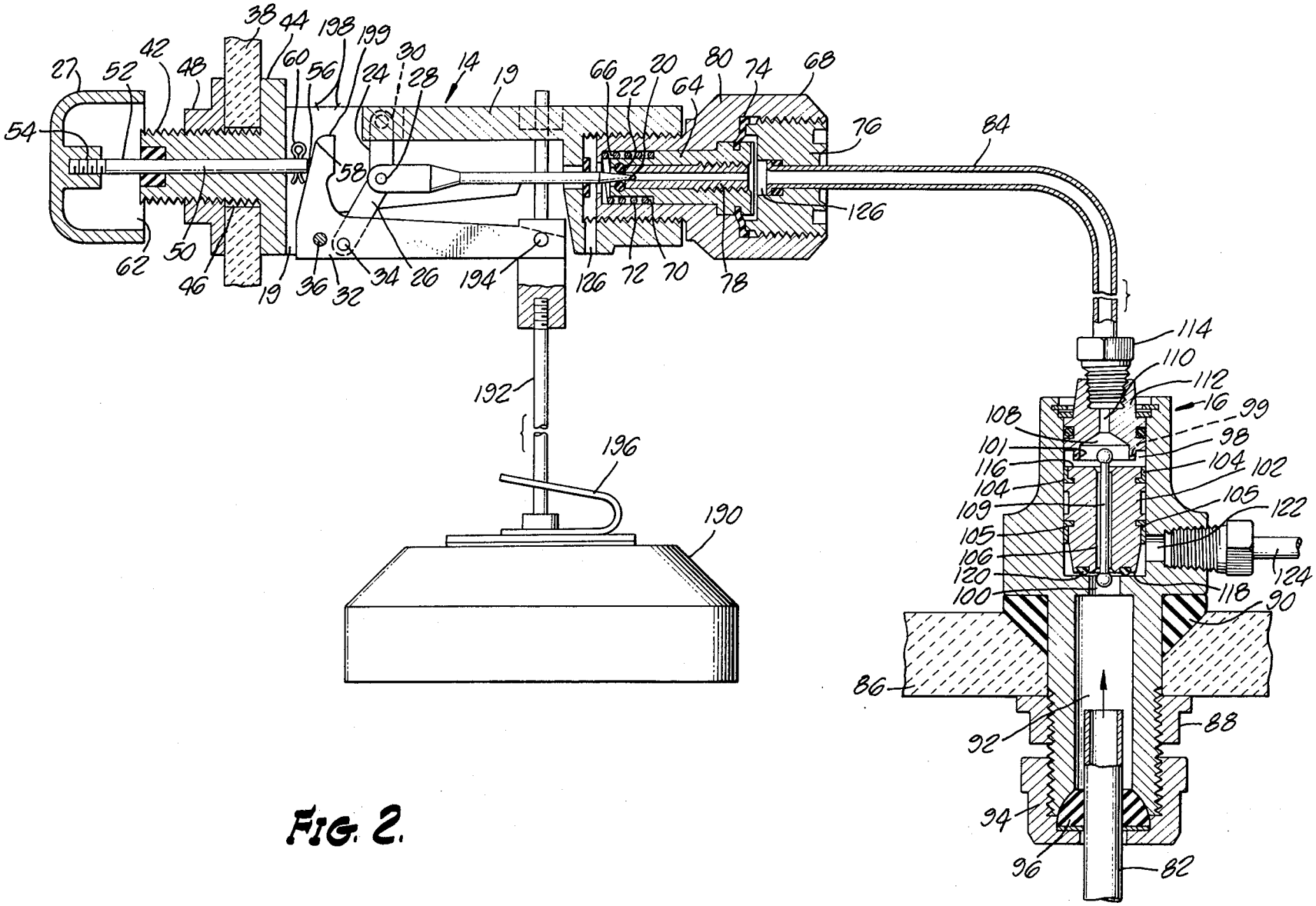
FIG. 2 is a sectional view of the push-button actuated needle valve, control float and direction flow mechanism.
Figure 3:
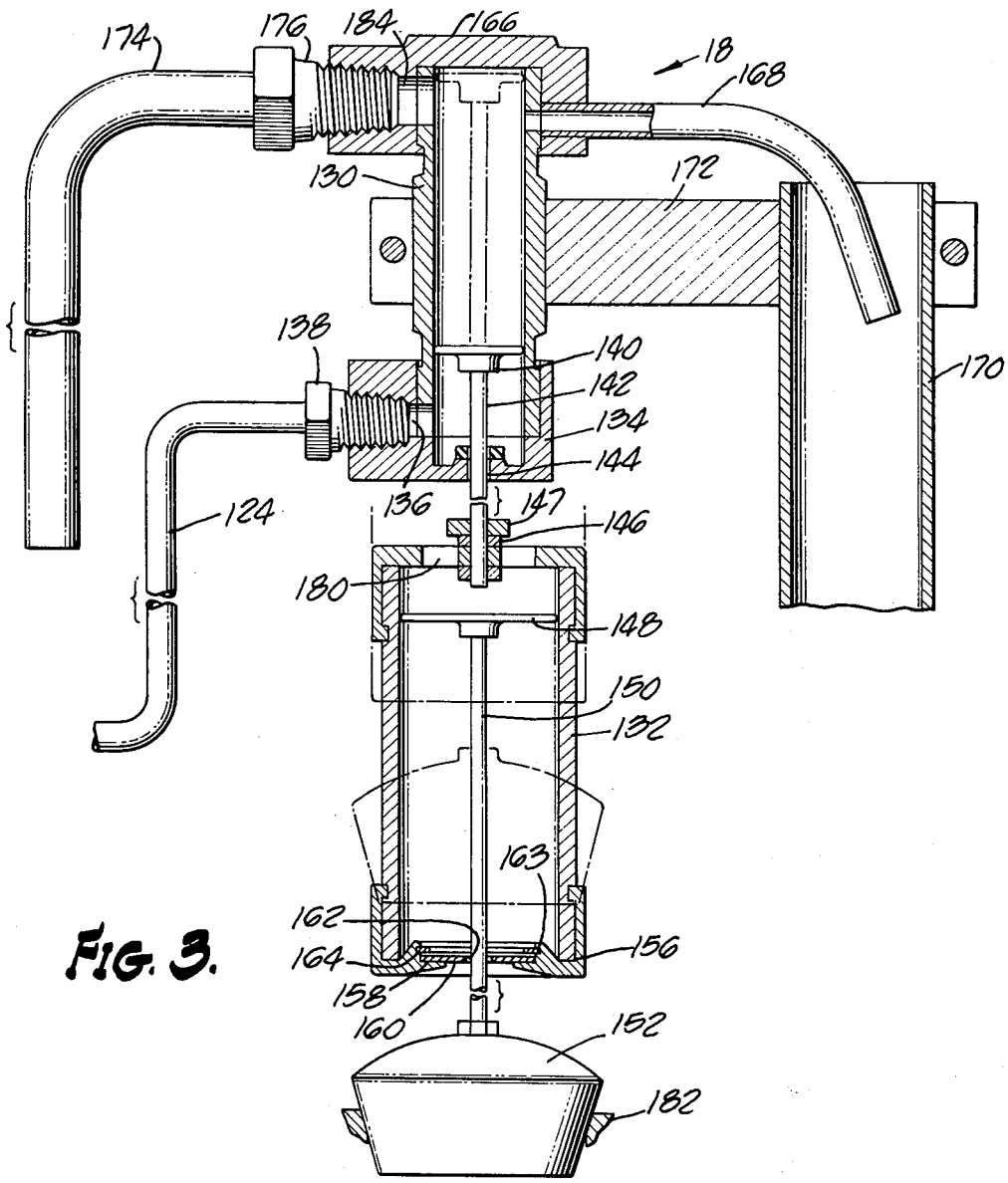
FIG. 3 is a sectional view of the lifting mechanism and tank ball.

Referring now in detail to the drawings, FIGS. 1–3 illustrate the preferred embodiment of the present invention. The control system shown therein is a flush mechanism 10 for toilets 12 of the water tank type. The flush mechanism is essentially comprised of a push-button control valve 14, direction flow valve mechanism 16 and lifting assembly 18. The control valve 14 which is of the needle valve type is best seen in FIG. 2 and includes a support frame 19, needle valve 20, floating valve seat 22, scissor arms 24 and 26 and actuating button 27. The needle valve 20 is pivotally secured at its rearward end to scissor arms 24 and 26 by pin 28. Scissor arm 24 is pivotally secured at its other end to the upper portion of the valve frame by pin 30 and scissor arm 26 is pivotally secured to the valve controller level 32 by means of pin 34. The valve controller level is in turn pivotally secured to the valve support frame 19 by pin 36 and is rotatable about pin 36 to actuate the needle valve 20, as will be described.

The control valve 14 is mounted on a wall 38 of the toilet tank or cistern 40 by means of a threaded extension 42 which is shown to be integrally formed with the base portion 44 of frame 19. The threaded extension is inserted through an aperture 46 in the wall 38 of the toilet tank and a threaded fastening means 48 is tightened about the protruding portion of extension 42, as seen in FIG. 2 to secure the control valve to the wall portion of the toilet tank. An actuating rod 50 is slidably mounted within and extends through the base portion of the frame and extension 42. The rearward end 52 of rod 50 has threads 54 thereon for securing the rod to the actuating button 27. The forward end 56 of the actuating rod 50 abuts a caming surface 58 of control lever 32 and has a stop means 60 mounted thereon to prevent the rod from being pulled through the base portion of the valve frame. When the actuating button 27 is pressed, the actuating rod 50 moves forward along the caming surface 58 of the control lever 32, causing the lever to pivot clockwise about pin 36. This movement of the lever causes the scissor arms 24 and 26 to retract the needle valve 20 from the valve seat 22, thereby actuating or opening the control valve 14. A recessed area 62 is provided in the forward side of the actuating button 27 to accommodate the rearward portion of the threaded extension 42 when the button is depressed to open the control valve.

Valve seat 22 is mounted on a support stem 64 and is comprised of an annular ring constructed of a standard rubber compound or other suitable material. The seat 22 is affixed to the rearward portion of the support stem so as to be in axial alignment with the needle valve 20 so that upon the needle valve being disposed in the forward position, as seen in FIG. 2, the valve seat is in sealing engagement therewith. The support stem 64 is slidably mounted within an elongated channel 66, centrally disposed within the valve stem housing 68. The rearward portion of the valve stem is of a reduced diameter to provide an annular chamber 70 thereabout. A coil spring 72 is disposed within the annular chamber. An annular diaphragm 74 is held by its outer perimeter portion within the valve stem housing 68 by means of a threadably mounted plug 76 and extends between the valve stem housing and the valve seat support stem and is secured to the valve stem about the inner perimeter portion thereof. Diaphragm 74 together with the coil spring 72 controls the movement of the valve seat support stem and valve seat within the elongated channel, as will be described. A threadably mounted valve stem insert 78 is utilized to secure the valve seat to the valve support stem 64.

The control valve 14 communicates with a standard water inlet 82 through conduit 84 and a direction flow valve mechanism 16. The valve mechanism 16 is mounted in the floor 86 of the toilet tank and is secured in sealing engagement therewith by a threaded fastening member 88 and an annular compressible seal 90. A chamber 92 is provided in the lower end of the direction flow or diverter mechanism and is held in communication with the water inlet by means of threaded fitting 94 and an annular compressible seal 96. The direction control flow valve 16 also has an upper chamber 98 which is in fluid communication with the lower chamber 92 through opening 100. A valve piston 102 is slidably mounted within the upper chamber and is provided with L-shaped upper and lower lip seals 104 and 105 to maintain a fluid tight relationship between the piston and the walls of the upper chamber as the piston moves therein. A central channel 106 is disposed within the piston to communicate the lower chamber 92 with the upper portion 108 of chamber 98. A plurality of pressure relief slots 99 are disposed in a cylindrical stop 101 which abuts the piston in its raised position, to allow fluid flow therethrough. An orifice pin 109 extends through channel 106 to assure uniform flow therethrough and prevent clogging by foreign matter. It can be seen that the water under line pressure from the water inlet 82 passes to the control valve by way of the lower chamber 92, channel 106 in the piston and into conduit 84 through a central bore 110 in the diverter mechanism plug 112. Conduit 84 is secured to the plug by a threaded fitting 114.

The upper surface 116 of piston 102 is of a greater area than the lower surface 116, so that when control valve 14 is closed, the pressure exerted on the upper surface 116 of the piston is greater than that exerted by the incoming water on the lower surface 118 of the piston, causing the piston to be in the lower position, as seen in FIG. 2. The lower surface of the piston is provided with an annular sealing member 120 which prevents any fluid leakage about the lower side of the piston when the piston is in the lowered position. A water outlet 122 is provided in the side wall of the diverter mechanism which communicates a conduit 124 with the lower portion of the upper chamber 98. When the piston 102 is held in the lower position due to the pressure differential created by the reduced area of the lower surface of the piston, the incoming water is prevented from entering conduit 124 through the outlet 122 and can only flow through the piston and conduit 84 into the forward end 126 of the elongated channel 66 in the valve stem housing of control valve 14. The pressure created by this incoming water urges the valve stem and valve seat carried thereby against the tapered end of the needle valve 20, thereby holding the control valve in a closed position while causing a slight deformation of the diaphragm 74 and compression of coil spring 72.

To actuate the flushing mechanism, button 27 is depressed, causing clockwise rotation of the controlling lever 32 and withdrawal of the needle valve 20 of the valve seat 22. The withdrawal of the needle valve breaks the seal with valve seat 22 and allows water under line pressure to flow pass the open valve and spill into the tank through aperture 126, located downstream of the valve seat 22. The opening of the control valve relieves the pressure which was heretofore urging the valve seat against the needle valve and the valve seat and support stem immediately snap forward within the elongated chamber under the force of the diaphragm 74 and coil spring 72. The dual action of the needle valve and valve seat provides an extremely responsive control valve. With the opening of the control valve, the piston 102 within the upper chamber 98 of the diverter mechanism 16 is rapidly driven to the raised or open position by the pressure of the incoming water on the lower surface thereof and the relief of the pressure on the piston's upper surface. The water then passes through opening 122 in the side wall of the upper chamber and into conduit 124, which communicates with the lifting assembly 18, shown in detail in FIG. 3.

The lifting assembly 18 is comprised of an upper lift cylinder 130 and lower static cylinder 132. A fitting 134 is disposed about the lower end of lift cylinder 130 and forms an aperture 136 in the lower portion thereof. Conduit 124 communicates with the lower portion of the lift cylinder through aperture 126 and is secured thereto by threaded fastening means 138. A lifting piston 140 is disposed within the lift cylinder 130. Piston rod 142 extends downwardly from the piston through an aperture 144 in the lower portion of fitting 136 and is secured by fastening means 146 to the upper portion of the lower static cylinder 132. A diametrical clearance of about 0.001 – 0.005 inches is provided between the piston rod 144 and the walls defining aperture 144 and the clearance between piston 140 and the wall of the lifting cylinder is about 0.015 – 0.025 inches. A damping means 147 is disposed above the cylinder fastening means 146 to prevent contact between the lifting cylinder and lower static cylinder and thereby providing for quieter operation. A second piston 148 is provided in the lower static cylinder 132 which is carried by piston rod 150. Piston rod 150 extends through the bottom of the static cylinder 132 and carries the toilet tank ball 152. The bottom of the lower static cylinder is secured to a fitting 156 which forms the bottom wall of the static cylinder. The lower portion of fitting 156 defines an annular flange 158 which carries a check valve 160. The check valve has an aperture 162 therein through which piston rod 150 passes. A diametrical clearance is provided of about 0.005 – 0.015 inches between the piston rod 150 and the walls defining the aperture in check valve 160 and the clearance between piston 148 and the wall of the static cylinder is about 0.008 – 0.012 inches. Stops 164 are provided to retain the check valve in place during the operation of the flushing mechanism, although these stops do allow the check valve to float about 1/16 of an inch within the bottom of the static cylinder. The lift cylinder 130 is provided with an upper fitting 166 which defines the upper surface of the lift cylinder and carries the anti-siphon line 168 which communicates with a standard overflow tube 170, supported by bracket 172. Fitting 166 also provides an outlet for the tank fill line 174, which is secured to the fitting by threaded fastening member 176 and through which the toilet tank is refilled after flushing.

In operation, when the control valve 14 is opened by depressing actuating button 27 which withdraws the needle valve 20 from the valve seat 22, the upstream pressure against the slidably mounted valve seat 64 is reduced and the support and valve seat 22 carried thereby snaps forward under the force of the diaphragm 74 and helical spring 72, thereby providing a sure and rapid opening of the control valve to actuate the flushing mechanism. The pressure against the upper surface 116 of 102 in the diverter mechanism 16 immediately drops to 0 and the piston is forced rapidly against the upper surface of chamber 98, thereby allowing almost instantaneous water flow through conduit 124 to the lifting mechanism 18. The water enters the lifting cylinder 130 under line pressure and immediately raises piston 140 to the elevated position which is illustrated by phantom lines in FIG. 3. As the piston moves upwardly, it correspondingly lifts the lower static cylinder 132. As shown in FIG. 1, the lower static cylinder is disposed below the water level 178 in the toilet tank and as the static cylinder has an upper opening 180 therein and a diametric clearance between the check valve 160 and piston rod 150 in the lower end thereof, it is filled with water. When the static cylinder is quickly raised, the piston 148, and consequently the tank ball 152, is pulled upwardly therewith due to the presence of the static water beneath the piston 148, thereby allowing the water within the tank to flush down the cistern drain. It should be noted, however, that the lifting mechanism will operate if the lower static cylinder is only about one third submerged below the water level in the tank. This hydraulic flushing operation operates very smoothly and rapidly, only about one quarter of a second transpiring between the initial pressing of the actuating button and the lifting of the tank ball from the cistern drain.

Following the flushing of the toilet tank 40, the tank is refilled through the tank fill line 174. This begins to occur as soon as the piston 140 reaches the elevated position within the lifting cylinder 130, whereupon the water entering the lifting cylinder through conduit 124 communicates with fill line 174 through an opening 184 in fitting 166. Due to the clearance between the check valve 160 and piston rod 150 within the lower static cylinder, the water held within that cylinder begins to flow therethrough as soon as the water level within the toilet tank falls below the piston 148. As the water drains from the lower static cylinder, the tank ball slowly and accurately returns to the cistern drain 182 to form the desired seal therewith. Concurrently with the descent of piston 150 within the static cylinder, the piston 140 begins to descend within the lifting cylinder as the water therein passes from the lower end of the cylinder through the diametrical clearance about the piston rod 142. As the piston 140 descends, the lower static cylinder is returned to its nonoperative position, illustrated in FIG. 3, and check valve 160 floats upwards about 1/16 inch and the cylinder is again filled with water and readied for reactivation. This upward movement of the check valve is limited by a locking ring 163. The time delay necessary before the flush mechanism can be again operative depends solely on the line pressure which determines the rate at which the water tank is filled.

As the water within the toilet tank continue to rise, float 190, which is pivotally secured to the control lever 32 of control valve 14 by means of a rod 192, support block 193 and yoke 194, causes the controlling lever to move in a counterclockwise direction. This counterclockwise rotation of the controlling lever causes the needle valve 20 to move forwardly towards the valve seat 22. As the tapered end of the needle valve approaches the valve seat and restricts the area between the seat and needle valve, an upstream pressure build up occurs which overcomes the force exerted by the diaphragm 74 and coil spring 72 and forces the slidably mounted support to move rearward, urging the valve seat 22 against the tapered end of the needle valve 20, closing control valve 14. As soon as the control valve is closed, pressure builds up in the upper portion of chamber 98 within the diverter mechanism 16, causing the piston 102 therein to move downwardly and seal off conduit 124, thereby preventing further flow to the upper lifting cylinder 130.

In addition to providing a rapid and quiet flushing of the water tank, the toilet flush mechanism 10 also provides a water recovery mechanism, should a leak develop. As the water level drops within the tank, the float 190 would be correspondingly lowered, causing a slight clockwise rotation of the controlling lever 32. This would act to momentarily withdraw the needle valve 20 from a sealing engagement with the valve seat 22 and allow water to pass therethrough and into the tank via outlet 126. This opening of the control valve 14, however, would be insufficient to cause a lifting of the piston 102 within the diverter mechanism and a flushing of the water within the tank, as the opening of the control valve 14 would be very slight and not create the necessary pressure drop which results when the actuating button 27 is depressed.

Additional features of the preferred embodiment include an adjustable clip member 196 which is provided to vertically position the float 190 along rod 192 and thereby maintain a desired water level within the toilet tank. Finally, an indicator 198 can be provided on the upper portion of the control valve housing 19 to adjust the positioning of the controlling lever 32 to the line pressure prior to use. This is accomplished by rotating the valve seat housing 68 with respect to the frame which, due to the threaded engagement between the frame and valve seat housing would linearly displace the valve seat 22 and, correspondingly, needle valve 20, which in turn would cause a slight rotation of the controlling lever 32. When an indicator 199 on the upper extremity of the controlling lever is disposed beneath the indicating means 198, the controlling lever 32 has a vertical arcuate stroke of about 3/8 inch which has been found to be ideal for operation of the control valve 14 and allows the valve to function at all variable line pressures including those as low as about 1 psi. It should be noted, however, that such an adjustment is generally not necessary to the operation of the valve but could be utilized in accordance with line pressures of varying psi to optimize the functioning of the valve.

Figure 4:
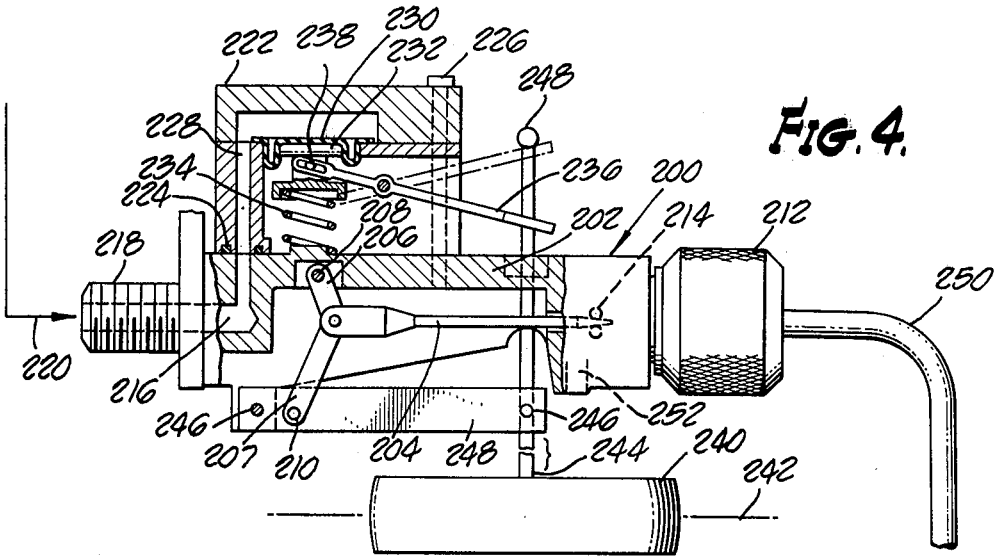
FIG. 4 is a sectional view of a second embodiment of the present invention.

A second embodiment of the present invention is illustrated in FIG. 4 of the drawings. Shown therein is a sealed level control valve having a particular adaptation for maintaining a desired level of fluid such as petroleum products or radioactive waste within a tank or the like. As can be seen from FIG. 4, the control valve 200 is somewhat similar to that of control valve 14 in the preferred embodiment and incorporates several of the features thereof. These features include a frame 202, needle valve 204, scissor arms 206 and 207 which are pivotally secured to the frame and control lever 248, respectively, by pins 208 and 210, valve seat housing 212 and a floatable valve seat 214. The valve seat is of the same configuration and floatably mounted as described in the prior and preferred embodiment. The valve frame 202 has an inlet opening 216 therein which communicates through fitting 218 with a pressure line indicated by arrow 220. The pressure line communicates the housing with pressurized source of gas or liquid. A sealed actuator housing 222 is disposed atop valve frame 202 and secured thereto by fastening means 224 and 226. Housing 222 has a conduit 228 therein which communicates with the inlet 216 in the valve frame. A diaphragm 230 separates the conduit from the interior of the housing. Disposed below the diaphragm is a piston 232 which is positioned and carried by a biasing spring 234. The spring is supported at its lower end by the valve housing. A holding rod 236 is pivotally mounted on housing 222 and slidably engages pin 238, disposed on piston 232. As fluid or gas under pressure is introduced into housing 222 through conduit 228, the piston 232 is pressed downwardly under the force of the gas or liquid acting on diaphragm 230. As the piston moves downwardly, spring 234 is compressed and holding rod 236 undergoes counterclockwise rotation to the position indicated by the phantom lines in FIG. 4.

The fluid level control valve 200 also carries a float 240 which is buoyed by the fluid 242 in the tank. The float is secured to the valve by means of a yoke 244 which extends about and over the extended end of holding arm 236. The yoke is also pivotally secured by pin 246 to a control lever 248 which corresponds in function to control lever 32 in the preferred embodiment of the invention. The control lever is, in turn, pivotally mounted of the frame 202 by pin 246, such that a clockwise rotation of the control lever about pin 246 expands scissors arm 206 and withdraws the needle valve 204 from the valve seat 214.

In operation, pressure can be applied to the piston 232 along line 220 and through conduit 228, causing the piston to compress spring 234 and rotate the actuator arm 236 counterclockwise against the cross bar 248 of yoke 244, as shown in phantom lines in FIG. 3. In this mode, the control valve 200 is held in the closed position preventing any fluid from entering the tank through inlet line 250, regardless of the fluid level in the tank, as the float is prevented from dropping with the fluid level by actuator arm 236. If the pressure in line 220 is reduced and the actuator arm returned to its normal lower position, the action of the control valve is controlled by the disposition of the float. Should the fluid level in the tank lower, the float 240 would drop accordingly, causing clockwise rotation of the control lever 248. Such movement of the control lever would act to withdraw the needle valve 204 from valve seat 214, thereby opening the valve and allowing fluid flow through inlet tube 250, pass valve seat 214 and into the tank through outlet 252, which is shown in dotted liness in FIG. 4 and corresponds with outlet 126 in the prior embodiment illustrated in FIG. 2. In this manner, valve 200 operates to automatically maintain a desired level of fluid within a tank. This level can be determined by the positioning of the float 240 along rod 244. The piston, diaphragm and actuator rod assembly provides a safety shutoff which maintains the valve in the closed position regardless of changes in the fluid level within the tank.

In uses other than relatively small flow situations, the fluid level control valve 200 is preferably used in conjunction with a flow valve utilizing a pressure differential such as the direction flow valve mechanism 16 described above. Although with smaller volumes of fluid control, valve 200 has been found to be quite adequate without the need for additional valve control.

Modification and changes may be made in carrying out the present invention without departing from the spirit and the scope thereof. Insofar as these changes and modifications are within the purview of the appended claims, they are to be considered as part of the invention.

I claim:

1. A flushing mechanism for toilets of the water tank type which comprises:

a. a control valve assembly;

b. means for actuating said control valve assembly;

c. means for lifting the tank ball from the tank drain; and d. means responsive to said control valve assembly for directing a fluid flow to said lifting means upon actuation of said control valve assembly, said responsive means comprising a chamber having an inlet for receiving pressurized fluid and a pair of outlets, a first of said outlets communicating with said control valve assembly and the other of said outlets communicating with said lifting means, said other outlet being disposed between said inlet and said first outlet, and a pressure responsive piston slidably mounted within said chamber for alternately sealing and communicating said other outlet with said inlet.

2. The combination of claim 1 wherein said pressure responsive piston has a channel extending therethrough, a first end of said piston facing said inlet and the other end of said piston facing said first outlet and communicating with said control valve assembly, said other end of said piston having an area greater than said first end so that when said control valve assembly is in a closed position, the pressure on said other end of said piston is greater than the pressure on said first end thereby urging said piston toward said inlet and over said other outlet communicating with said lifting means and preventing fluid flow to said lifting means, and upon actuation of said control valve assembly, the pressure on said other end of said piston is reduced, causing said piston to move towards said first outlet and out of sealing engagement with said other outlet, thereby allowing fluid flow to said lifting means.

3. A flushing mechanism for toilets of the water tank type which comprises:

a. a control valve assembly;

b. means for actuating said control valve assembly;

c. means for lifting the tank ball from the tank drain, said means comprising a cylinder having an inlet therein, a piston disposed within said cylinder, a piston rod carried by said piston and extending outwardly of said cylinder, a second cylinder carried by said piston rod, a piston disposed within said second cylinder, a piston rod extending from said piston and being secured to said tank ball, and a valve disposed in the lower end of said second cylinder about said piston rod extending therefrom to allow fluid flow therethrough; and d. valve means responsive to said control valve assembly and in fluid communication therewith for directing a fluid flow to said cylinder inlet upon actuation of said control valve assembly, said fluid flow raising said first piston, piston rod and second cylinder thereby raising said ball from said drain and flushing said tank.

4. A flushing mechanism for toilets of the water tank type which comprises:

a. a control valve assembly comprised of a valve support means, a needle valve carried by said support means, a valve seat housing, a valve stem slidably mounted within said housing, a valve seat carried by said stem in axial relation with said needle valve, means for moving said needle valve from and towards said valve seat, means for moving said valve seat from said needle valve upon said needle valve being moved from said valve seat, and valve inlet means disposed in said housing;

b. means for actuating said control valve assembly;

c. means for lifting the tank ball from the tank drain; and d. valve means responsive to said control valve assembly and in fluid communication therewith for directing a fluid flow to said lifting means upon actuation of said control valve assembly, said fluid flow raising said ball from said drain, thereby flushing said tank.

5. The combination of claim 4 wherein said moving means comprises a control lever pivotally mounted on said valve support means and having a caming surface thereon; a pair of arms pivotally connected at one end to said needle valve, one of said arms being pivotally connected at the other end thereof to said valve support means and the other of said arms being pivotally connected at the other end thereof to said control lever whereby rotation of said control lever causes said needle valve to undergo linear movement with respect to said valve seat; and a follower rod adapted to abut said caming surface and impart rotational movement to said control lever.

6. The combination of claim 4 wherein said lifting means comprises a cylinder having an inlet in communication with said outlet in said chamber in said valve means (d); a piston disposed within said cylinder; a piston rod carried by said piston and extending outwardly of said cylinder; and means for connecting said piston rod to the tank ball whereby upon fluid entering said cylinder through said inlet therein said piston and piston rod are raised thereby lifting the tank ball from the tank drain.

7. The combination of claim 6 wherein said connecting means comprises a second cylinder carried by said piston rod; a piston disposed within said second cylinder; a piston rod extending from said piston and being secured to said tank ball; and a valve disposed in the lower end of said second cylinder about said piston rod extending therefrom to allow fluid flow therethrough and thereby allow the tank ball to return to the tank drain.

8. The combination of claim 7 including a float member carried by said control lever for imparting rotational movement thereto causing said needle valve to move toward said valve seat upon said float being elevated by the rising water level within the toilet tank during refilling thereof.

9. The combination of claim 4 wherein said valve seat moving means comprises a diaphragm extending between said valve seat housing and said valve stem, and a coil spring disposed within said valve seat housing about said valve stem.

10. A flushing mechanism for toilets of the water tank type which comprises:

a. a control valve assembly comprised of a valve support means, a needle valve carried by said support means, a valve seat housing, a valve seat slidably mounted within said housing in axial alignment with said needle valve and means for moving said needle valve from and towards said valve seat;

b. means for actuating said moving means;

c. means for lifting the tank ball from the tank drain; and d. means responsive to said control valve assembly for directing a fluid flow to said lifting means upon actuation of said control valve assembly, said responsive means comprising a chamber having an inlet for receiving a pressurized fluid and a pair of outlets, a first of said outlets communicating with said control valve assembly and the other of said outlets communicating with said lifting means, said other outlet being disposed between said inlet and said first outlet, and a pressure responsive piston slidably mounted within said channel for alternately sealing and communicating said other outlet with said inlet.

11. The combination of claim 10 wherein said piston has a channel extending therethrough, a first end of said piston facing said inlet and the other end of said piston facing said first outlet, said other end of said piston having an area greater than said first end such that when the control valve assembly is in a closed position, the pressure on said other end of said piston is greater than the pressure on said first end thereby urging said piston toward said inlet and over said other outlet and preventing fluid flow to said lifting means, and upon actuation of said moving means, the pressure on said other end of said piston is reduced, causing said piston to move toward said first outlet and out of sealing engagement with said other outlet thereby allowing fluid flow to said lifting means.

12. The combination of claim 10 including a valve stem slidably mounted within said housing, said valve seat being carried by said valve stem, and means for moving said valve stem from said needle valve upon said needle valve being moved from said valve seat.

13. The combination of claim 12 wherein said valve seat moving means comprises a diaphragm extending between said housing and said valve stem and a coil spring disposed within said housing about said valve stem.

14. The combination of claim 10 wherein said moving means comprises a control lever pivotally mounted on said valve support means and having a caming surface thereon; a pair of arms pivotally connected at one end to said needle valve, one of said arms being pivotally connected at the other end thereof to said valve support means and the other of said arms being pivotally connected at the other end thereof to said control lever whereby rotation of said control lever causes said needle valve to undergo linear movement with respect to said valve seat; and a follower rod adapted to abut said caming surface and impart rotational movement to said control lever.

15. The combination of claim 11 including a float member carried by said control lever for imparting rotational movement thereto causing said needle valve to move toward said valve seat upon said float being elevated by the rising water level within the toilet tank during refilling thereof.

16. The combination of claim 10 wherein said lifting means comprises a cylinder having an inlet in communication with said outlet in said chamber in said valve means (d); a piston disposed within said cylinder; a piston rod carried by said piston and extending outwardly of said cylinder; and means for connecting said piston rod to the tank ball whereby upon fluid entering said cylinder through said inlet therein said piston and piston rod are raised thereby lifting the tank ball from the tank drain.

17. The combination of claim 16 wherein said connecting means comprises a second cylinder carried by said piston rod; a piston disposed within said second cylinder; a piston rod extending from said piston and being secured to said tank ball; and a valve disposed in the lower end of said second cylinder about said piston rod extending therefrom to allow fluid flow therethrough and thereby allow the tank ball to return to the tank drain.

* * * * *